US006884189B2

(12) United States Patent
Fair

(10) Patent No.: US 6,884,189 B2
(45) Date of Patent: Apr. 26, 2005

(54) ADJUSTABLE BASKETBALL GOAL SYSTEM

(76) Inventor: Dennis M. Fair, 5395 Beaver Creek Rd., New Hill, NC (US) 27562

( * ) Notice: Subject to any disclaimer, the term of this patent is extended or adjusted under 35 U.S.C. 154(b) by 104 days.

(21) Appl. No.: 10/630,895

(22) Filed: Jul. 31, 2003

(65) Prior Publication Data

US 2004/0023737 A1 Feb. 5, 2004

Related U.S. Application Data

(62) Division of application No. 10/087,781, filed on Mar. 5, 2002, now Pat. No. 6,626,773.

(51) Int. Cl.[7] ..... A63B 63/08
(52) U.S. Cl. ..... 473/483; 473/479; 224/519
(58) Field of Search ..... 473/481–484, 473/479; D21/701; 254/47; 248/208.11, 281.11, 283.1, 284.1, 295.11; 224/519

(56) References Cited

U.S. PATENT DOCUMENTS

D202,716 S * 11/1965 Procter ..... D21/702
D255,040 S * 5/1980 Cochran et al. ..... D21/702
4,526,367 A * 7/1985 Haston et al. ..... 473/483
4,801,142 A * 1/1989 Friesen ..... 473/484
4,951,944 A * 8/1990 Morgan ..... 473/483
5,102,128 A * 4/1992 Geise ..... 473/483
5,547,185 A * 8/1996 Wagner et al. ..... 473/483
6,019,690 A * 2/2000 Parr et al. ..... 473/481

* cited by examiner

*Primary Examiner*—Stephen P. Garbe
*Assistant Examiner*—M. Chambers
(74) *Attorney, Agent, or Firm*—Richard C. Litman

(57) ABSTRACT

An adjustable basketball goal system wherein a basketball goal is mounted to a moveable sleeve slidable a post. A ring is attached to the sleeve and connected to a cable. The cable runs through a pulley at the top of the post, then back through the ring and down to a winch. The winch functions to draw in cable thereby raising the sleeve and the attached goal, to release cable and thereby lower the goal, and to hold the cable in position and thereby fix the position of the goal.

3 Claims, 6 Drawing Sheets

ADJUSTABLE BASKETBALL GOAL SYSTEM

This application is a DIVISIONAL application of U.S. application Ser. No. 10/087,781, filed Mar. 5, 2002, now U.S. Pat. No. 6,626,773.

BACKGROUND OF THE INVENTION

1. Field of the Invention

The present invention relates to sports equipment. In particular, this invention relates to a system for adjusting basketball goals.

2. Description of the Related Art

Almost as soon as James Naismith invented basketball inventors have attempted to provide an affordable, easy to operate, easy to construct system which could adjust the height of a basketball goal. No device truly accomplished this goal until the present invention.

U.S. Pat. No. 4,801,142 to Friesen discloses an adjustable basketball goal with a lift cable and winch for raising and lowering a basketball goal. This device uses several parallel arms which pivot to adjust the height of the basketball goal. The '142 patent differs from the present invention in that the present invention adjusts using a sleeve riding on a post rather than two parallel arms to adjust the height of the attached basketball goal.

U.S. Pat. No. 4,951,944 to Morgan discloses an automatically adjustable basketball goal having an actuator, sleeve pipe, and a mount pipe. This invention adjusts the height of the basketball goal by telescoping the sleeve pipe along the mount pipe using the actuator. The '944 patent can be differentiated from the present invention in that the present invention uses a cable and pulley system to adjust the height of the basketball goal, and the actuator (winch) of the present invention is not mounted to an actuator pole as is the '944 invention.

U.S. Pat. No. 5,102,128 to Geise discloses a portable basketball goal with a mast, support arm and frame assembly, all of which may be raised and lowered. The manner in which the support arm is raised along the mast can be differentiated from the present invention in that the lifting cable used in the '128 invention is attached to the basketball goal support arm; the support arm is not attached to the mast in a sliding sleeve arrangement. Furthermore, the '128 invention is not described as being capable of motorized operation.

U.S. Pat. No. 5,547,185 discloses an adjustable basketball pole and goal having a pole with a plurality of rails along which a collar is pulled by a crank, line and pulley system. The '185 invention differs from the present invention in that the present invention does not require the use of rails to insure stable use and operation of the invention.

None of the above inventions and patents, taken either singularly or in combination, is seen to describe the instant invention as claimed. Thus an adjustable basketball goal system solving the aforementioned problems is desired.

SUMMARY OF THE INVENTION

The present invention has a post, sleeve, mounting assembly, pulley, winch, a ring and a cable. The post is mounted into the ground and the sleeve is disposed around the post. The mounting assembly and ring are attached to the sleeve, the winch is mounted to the post, and the cable runs from the winch, through the ring, through the pulley and then back to the ring where it is finally secured.

When in use the winch retracts or releases lengths of the cable, thereby moving the sleeve up and down the post.

Moving the sleeve moves the mounting assembly and the attached basketball goal.

Accordingly, it is a principal object of the invention to provide an adjustable basketball goal system.

It is another object of the invention to provide an adjustable basketball goal system which is simple to construct.

It is a further object of the invention to provide an adjustable basketball goal system which is easy to operate.

Still another object of the invention is to provide an adjustable basketball goal system which may be electrically operated.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
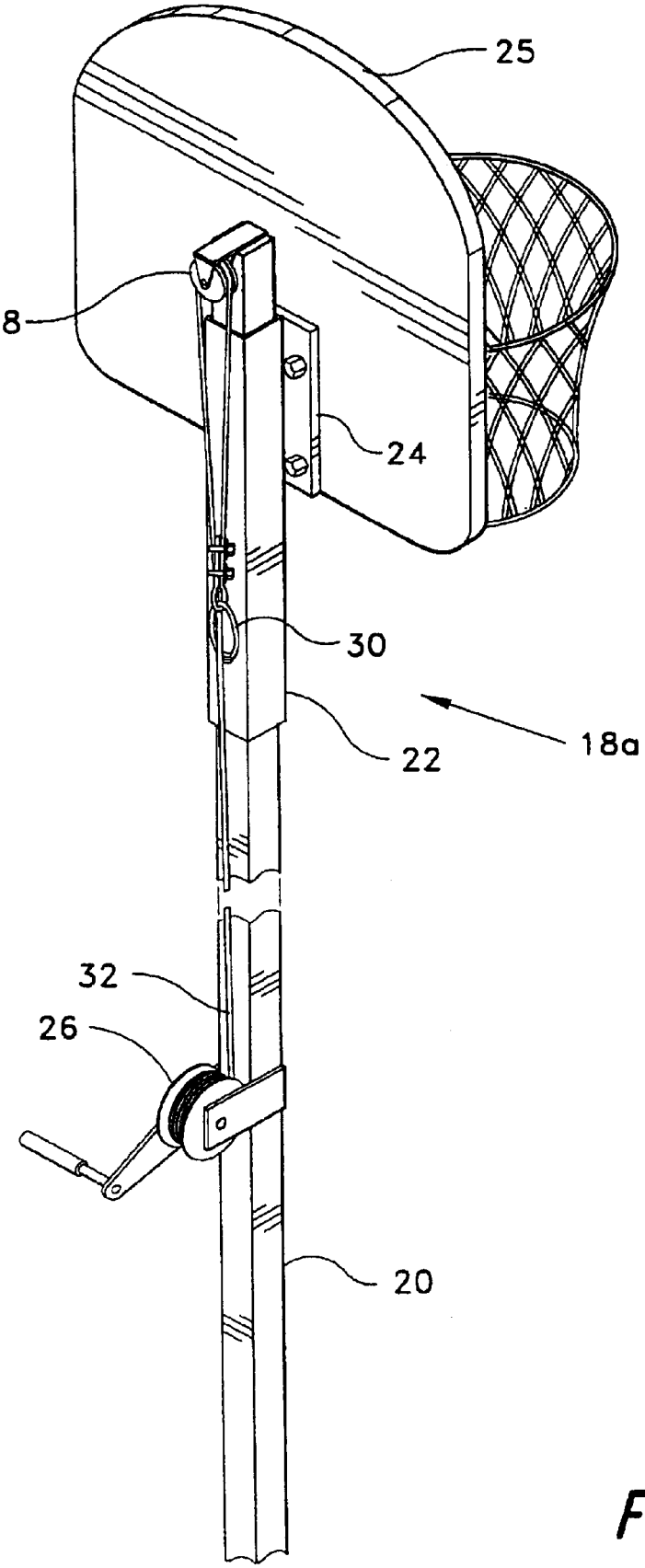
FIG. 1 is a rear perspective view of a adjustable basketball goal system according to the present invention with the basket raised.

The present invention is an adjustable basketball goal system. As seen in FIG. 1, the system has a hollow post 20 which is rectangular in cross section, with a top, bottom, front surface, and back surface. The post 20 is ordinarily affixed into the ground in a vertical orientation. A sleeve 22 having a front surface, a back surface, and a rectangular cross section is disposed around the post 20. Welded to the front surface of the sleeve 22 is a mounting bracket 24. The mounting bracket 24 connects the sleeve to a backboard 25 having a basket mounted thereon. The backboard 25 and basket are collectively referred to as a basketball goal in the present application. Basketball goals are well known in the art and the mounting bracket 24 is capable of attaching to any standard basketball goal.

A hand winch 26 is welded near the bottom of the back surface of the post 20 and has a handle, crank, spool and brake. The winch is of the type typically used in connection with boat trailers and is well known in the art. A pulley 28 is welded to the top of the back surface of the post. A ring 30 is welded to the back surface of the sleeve 22. A cable 32 is spooled around the winch 26 and extends from the winch 26 towards the top of the post 20, runs through the ring 30, around the pulley 28 and then back to the ring 30 where it is secured.

Figure 2:
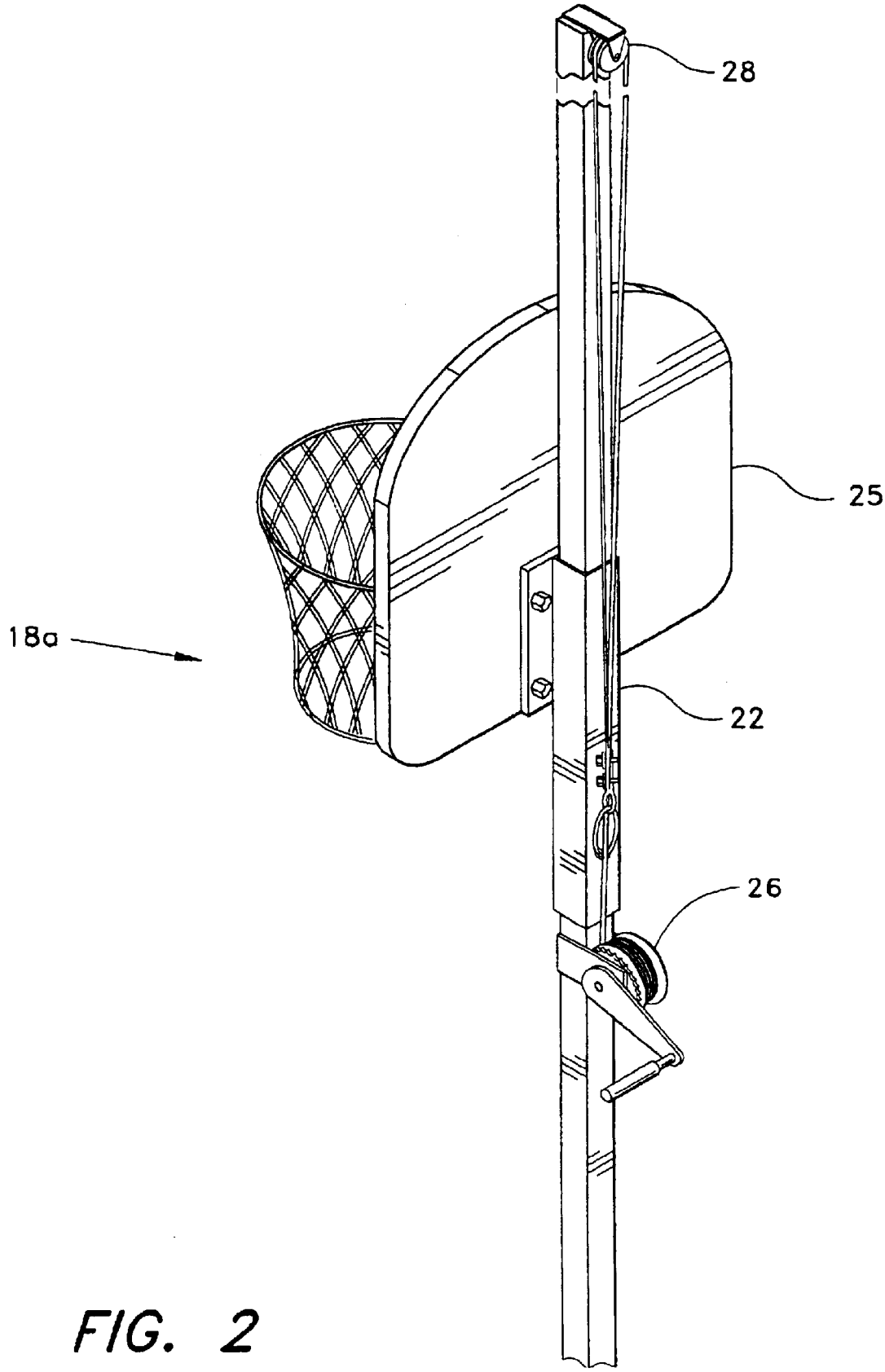
FIG. 2 is a rear perspective view of a adjustable basketball goal system according to the present invention with the basket lowered.

When in operation the cable 32 may either be drawn into, released from or held by the winch 26. When the cable 32 is drawn into the winch 26 the sleeve and the attached basketball goal are drawn towards the top of the post 20. FIG. 1 shows the basketball goal 25 raised into its highest position. When the cable 32 is released the reverse occurs and the basketball goal 25 is moved by gravity toward the bottom of the post 20. FIG. 2 shows the basketball goal 25 in its lowest position. The brake on the winch 26 may be used to prevent the winch 26 from releasing the cable 32 and will thereby fix the position of the basketball goal 25. The basketball goal 25 may be fixed into any number of positions between the highest position as seen in FIG. 1 and the lowest position shown in FIG. 2.

Figure 3:
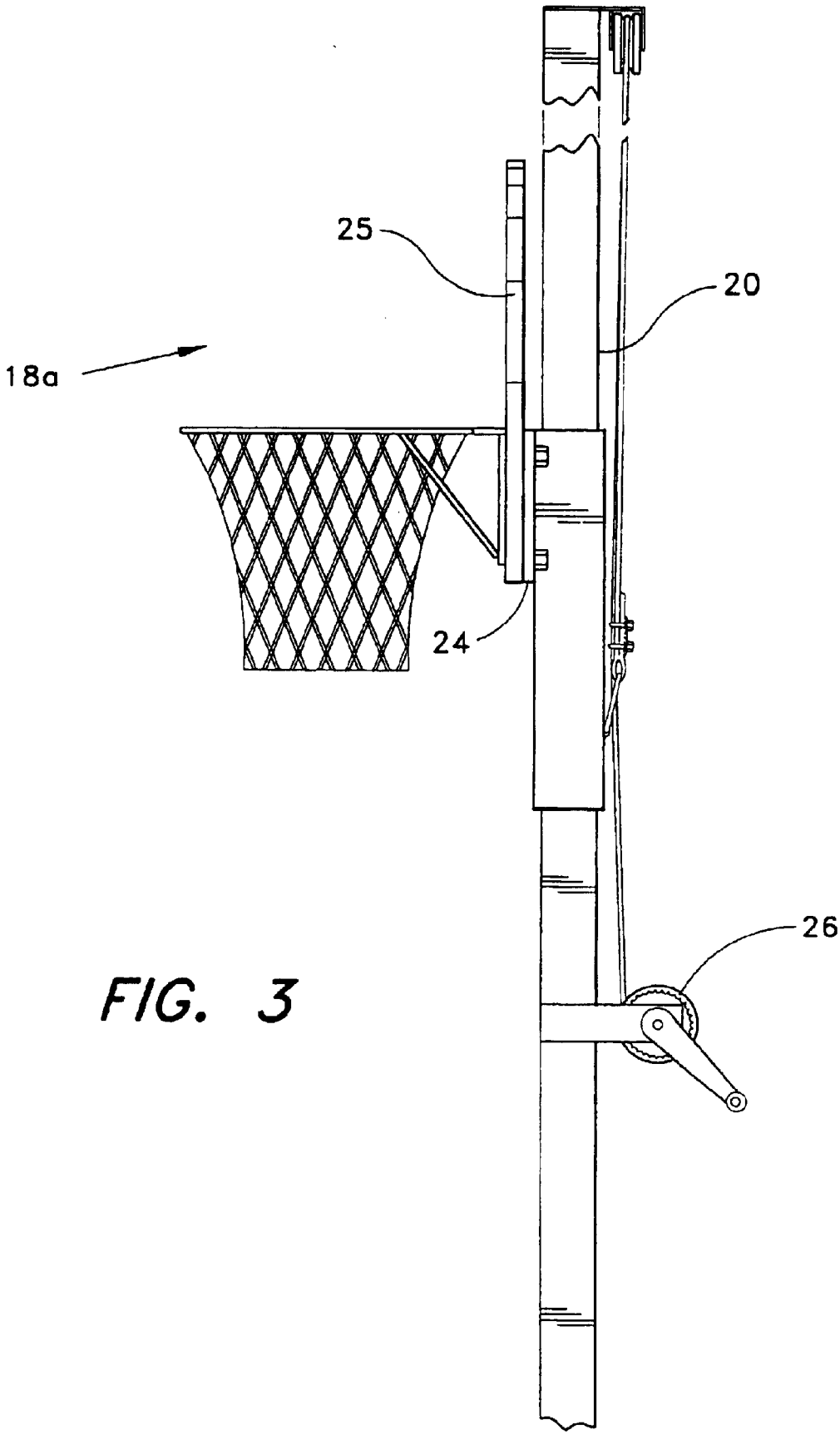
FIG. 3 is a side view of the first embodiment of the present invention.

FIG. 3 shows a side view of the basketball goal adjustment system with a mounting bracket 24 clearly visible. The width of the mounting bracket 24 may be varied depending on the distance desired between the basketball goal 25 and the post 20.

Figure 4:
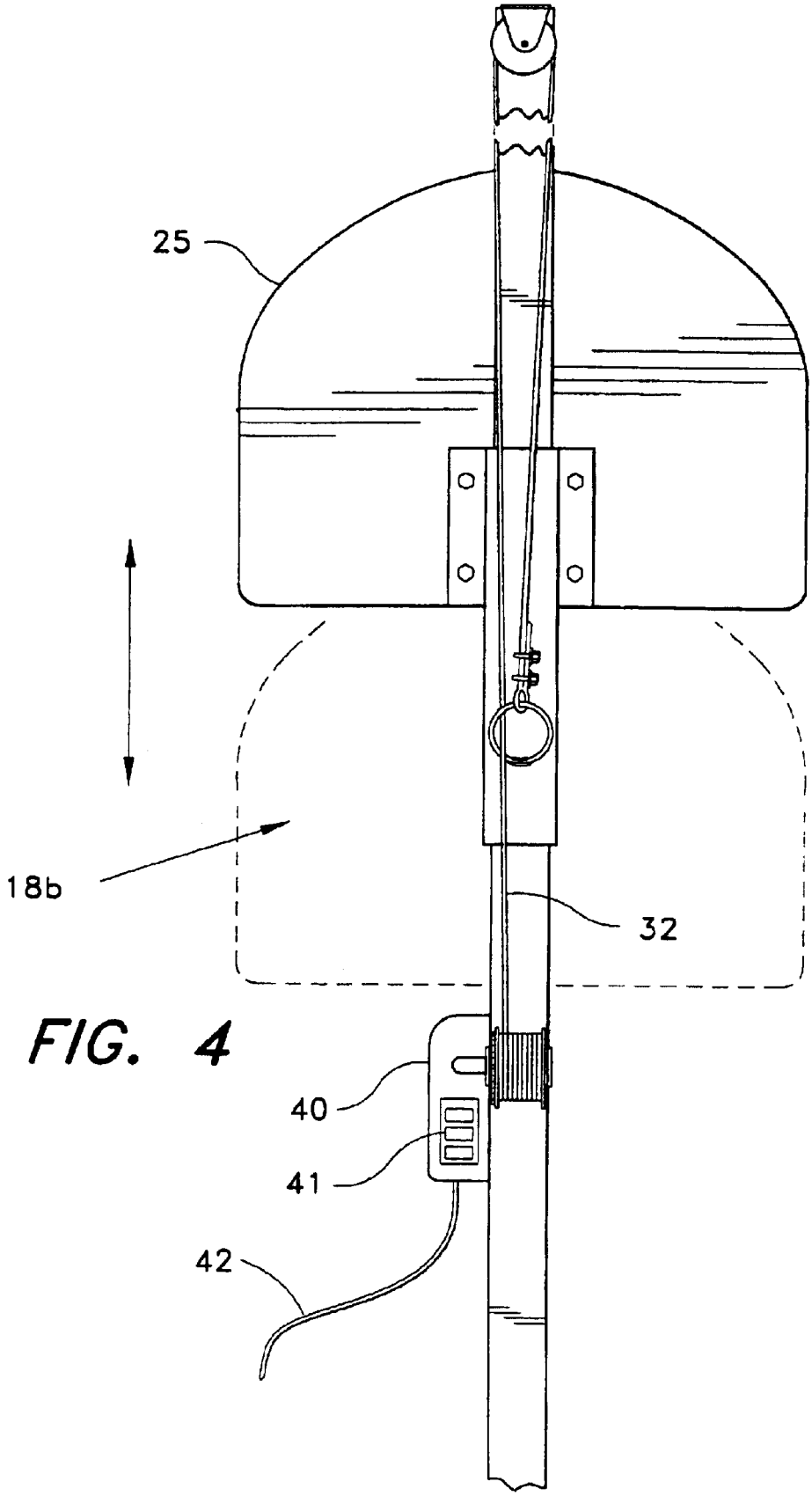
FIG. 4 is a back view of a second embodiment of the present invention.

In a second embodiment, as seen in FIG. 4, the hand winch 26 of the first embodiment is replaced with an electric winch 40. An electric winch 40 of this type is well known in the art and consists generally of an electric motor, a spool, a housing, a control means and a brake. The electric winch 40 is connected to an external electric power supply through and electric cord 42. The electric winch 40 also has a control means 41 which can be used to signal the electric winch to draw-in or release the cable 32. The control means may also activate a brake which holds the spool in a fixed position and thereby prevents the release of cable 32.

Figure 5:
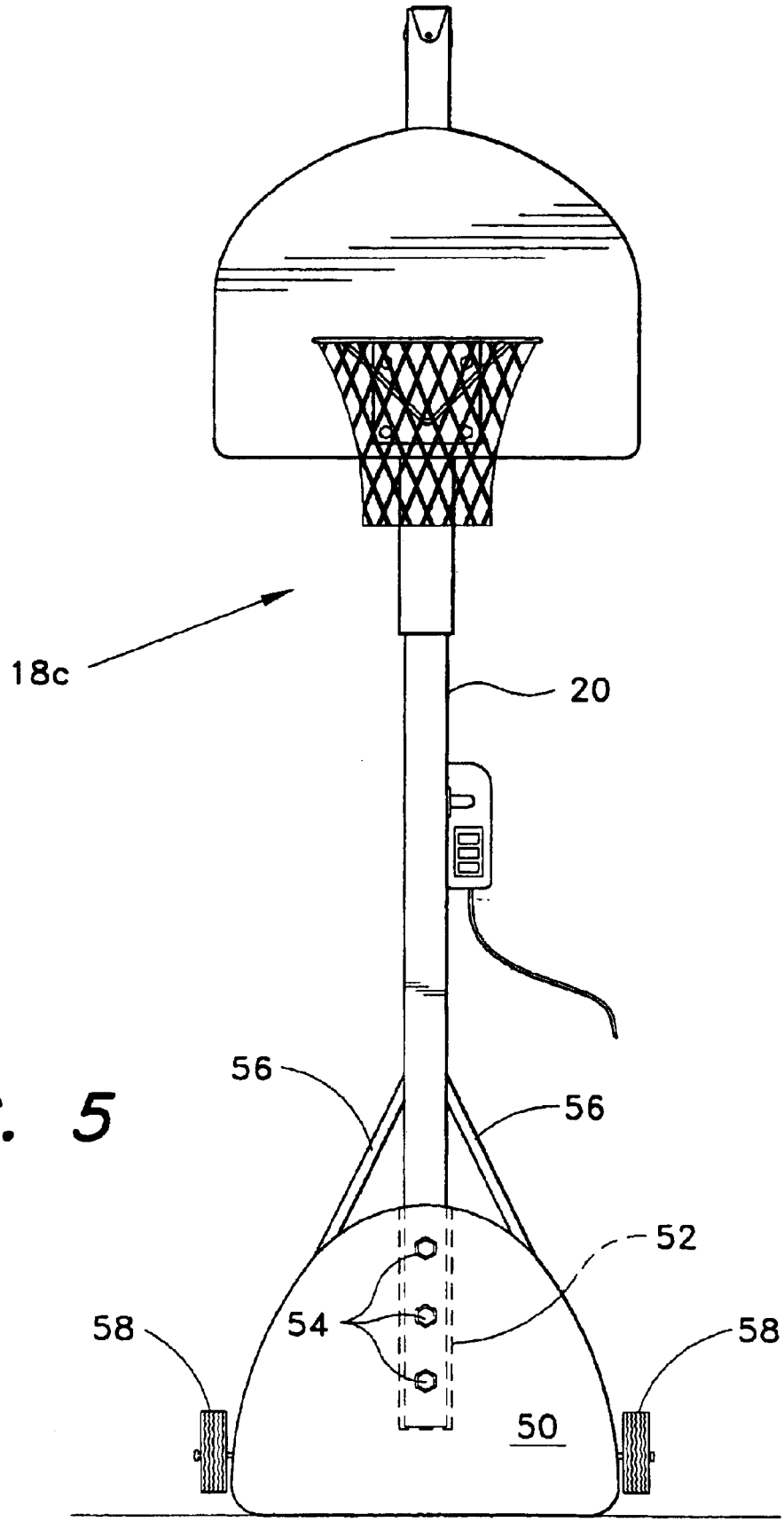
FIG. 5 is a front view of a third embodiment of the present invention.

A third embodiment of the present invention 18*c*, shown in FIG. 5, is designed for easy relocation and use without being secured into the ground. This embodiment has a hollow base member 50 with a flat bottom. The base member 50 may be filled with sand or other suitable material in order to provide ballast. A socket or receptacle 52 is defined in the base member 50. The post 20 is positioned inside the receptacle 52 and may be secured therein with a number of bolts 54. Two support arms or struts 56 extend between the base member 50 and the post 20 and function to further support the post 20. Two wheels 58 are positioned on the sides of the container and function to allow the goal system 18*c* to be easily transported.

Figure 6:
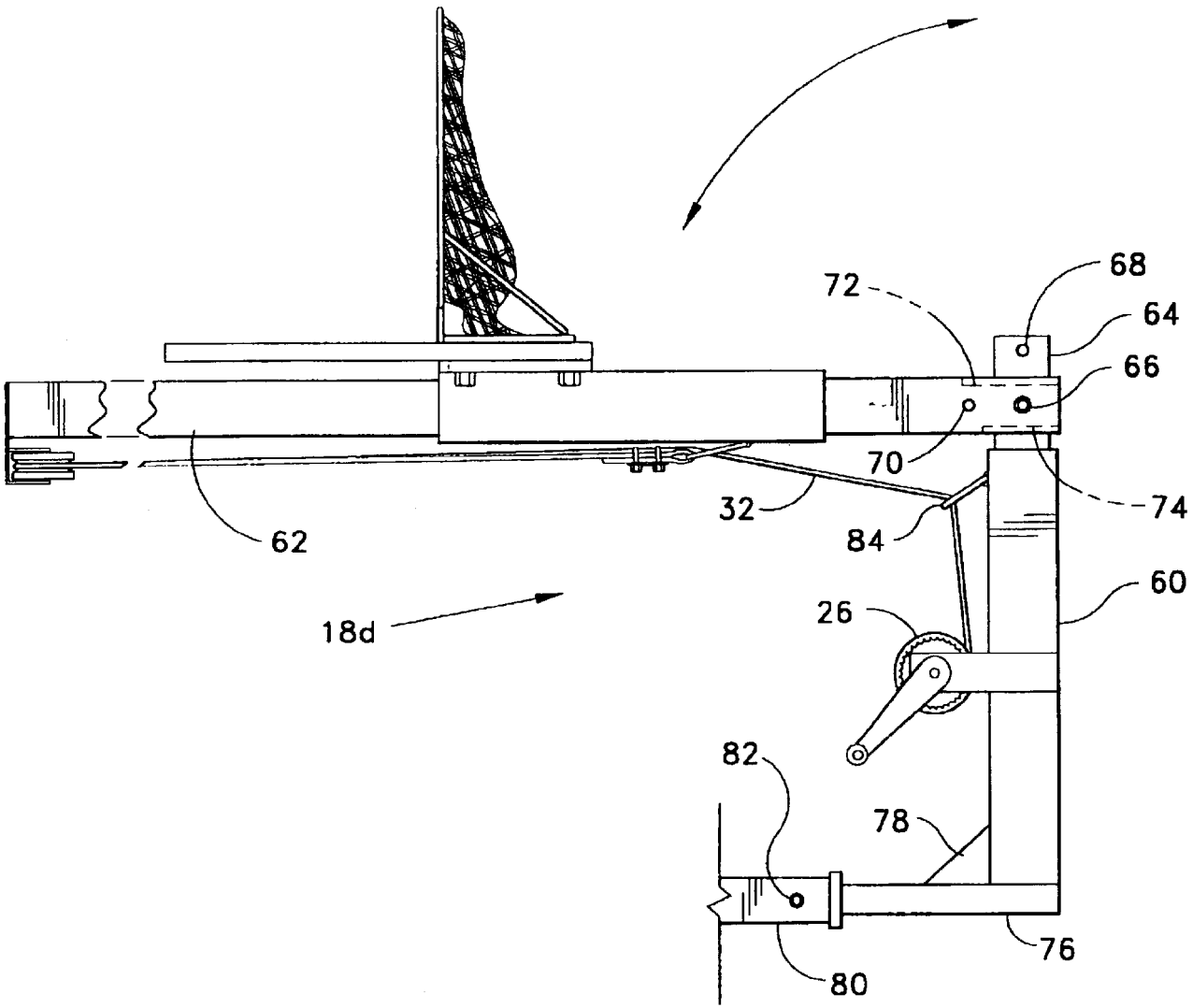
FIG. 6 is a side view of a fourth embodiment of the present invention.

FIG. 6 shows a fourth embodiment 18*d* of the present invention, which is designed to be mounted on a trailer hitch. The post in this embodiment is made of two pieces, a hollow base member 60 which is rectangular in cross section, and a hollow pivot member 62 which is rectangular in cross section. The base 60 and pivot 62 members are connected to one another by a pivot brace 64. The pivot brace 64 has a top and bottom and is rectangular in cross section. The bottom of the pivot brace 64 is preferably welded to the inside of the base member 60. The pivot member 62 is secured to the pivot brace 64 with a pin 66 which extends through both sides of the pivot brace 64 and both sides of the pivot member 62. Portions 72 and 74 of the front and rear surfaces of the pivot member 62 have been removed so that the pivot member 62 may rotate around the pin 66, thereby moving between a vertical and an approximately horizontal position.

When the pivot member 62 is positioned vertically holes 70 defined through both sides of the pivot member 62 and holes 68 defined through both sides of the pivot brace 64 are in registry. A pin may be inserted through the holes 70, 68 to hold the pivot member 62 in a vertical position. Ring 84 may be added to this embodiment to secure the cable 32 when the pivot member 62 is positioned horizontally.

A receiver hitch 76 is attached to the bottom of the base member 60 and is reinforced with a gusset flange 78. The receiver hitch is adapted to connect a trailer hitch 80 of the type commonly found on trucks and may be secured thereto with a pin 82.

It is to be understood that the present invention is not limited to the embodiments described above, but encompasses any and all embodiments within the scope of the following claims.

I claim:

1. A adjustable basketball goal system comprising:

a hollow base member having a front surface, a back surface, a top, a bottom and being rectangular in cross-section;

a receiver hitch having a first and second side, the first side being disposed upon the bottom of said base member, and said second side being adapted to be inserted into a vehicular trailer hitch;

a gusset flange disposed between the bottom of said base member and the first side of said receiver;

a pivot bracket having a front surface, back surface, two opposing side surfaces, a top, a bottom and being rectangular in cross-section, the bottom of the pivot bracket being disposed inside the top of said base member;

a hollow pivot member having a front surface, a back surface, two opposing side surfaces, a top and a bottom, the bottom being disposed upon said pivot bracket;

a pin, said pin extending through holes defined in the opposing side surfaces of said pivot member and through holes defined in both opposing side surfaces of said pivot bracket, two additional holes being defined in the opposing side surfaces of the pivot member, and two additional holes being defined in the opposing side surfaces of the bracket member, said holes being equidistant from said pin;

a sleeve disposed around said pivot member, the sleeve having a front surface and back surface;

a mounting bracket disposed on the front surface of said sleeve;

a basketball goal disposed upon said mounting bracket;

a pulley disposed on the top of the back surface of said pivot member;

a winch disposed on the bottom of the back surface of said base member;

a ring disposed on the back surface of said sleeve;

a cable having a first and second end, the first end of said cable being attached to said winch and the second end of said cable being disposed around said ring;

wherein said cable runs from said winch through said ring, around said pulley and then back to said ring.

2. An adjustable basketball goal system as in claim 1, further comprising:

a second ring disposed on the top of said base member;

wherein said cable runs through said second ring.

3. An adjustable basketball goal system as in claim 1 wherein: said winch has an electric motor, a power cord, and a selector switch.

* * * * *